United States Patent [19]

Wallace

[11] Patent Number: 4,468,020

[45] Date of Patent: Aug. 28, 1984

[54] METHOD AND APPARATUS FOR PRODUCING POP-UP BOOKLETS

[75] Inventor: Gerald L. Wallace, Pewaukee, Wis.

[73] Assignee: The Wessel Company, Elk Grove Village, Ill.

[21] Appl. No.: 386,008

[22] Filed: Jun. 7, 1982

[51] Int. Cl.[3] ..... B41F 13/58

[52] U.S. Cl. ..... 270/5; 493/324; 493/410; 493/959; 493/447; 270/21.1; 283/63 R

[58] Field of Search ..... 270/4–9, 270/16, 37, 41, 54; 101/226; 493/324, 361, 363, 366, 405, 439, 409–410, 446–447, 921, 959; 283/63 R; 40/411; 428/8; 46/35–36

[56] References Cited

U.S. PATENT DOCUMENTS

| | | | |
|---|---|---|---|
| 1,604,056 | 9/1926 | Lorenz | 493/324 |
| 2,085,435 | 6/1937 | Lohmann | 493/324 X |
| 2,201,479 | 5/1940 | Davidson | 46/35 |
| 2,360,973 | 10/1944 | Pedersen | 493/959 |
| 2,458,879 | 1/1949 | Schenk | 46/36 |
| 2,600,215 | 6/1952 | Florez | 493/324 |
| 2,661,559 | 12/1953 | Klein et al. | 46/35 |
| 2,683,391 | 7/1954 | Nichols | 283/63 R X |
| 2,884,738 | 5/1959 | Lohnes et al. | 46/36 |
| 3,326,365 | 6/1967 | Neureither et al. | 493/324 X |
| 3,665,817 | 5/1972 | Katz et al. | 270/41 |
| 3,743,273 | 7/1973 | Katz et al. | 270/41 |
| 3,779,786 | 12/1973 | Tone | 493/324 X |
| 3,866,900 | 2/1975 | Kebba | 270/5 |
| 3,907,271 | 9/1975 | Lyon, Jr. | 270/37 |
| 4,089,514 | 5/1978 | Skipworth | 270/5 |
| 4,420,148 | 12/1983 | Meadows | 493/439 X |

FOREIGN PATENT DOCUMENTS

| | | | |
|---|---|---|---|
| 770219 | 9/1934 | France | 46/36 |

*Primary Examiner*—E. H. Eickholt

*Attorney, Agent, or Firm*—Marshall, O'Toole, Gerstein, Murray & Bicknell

[57] ABSTRACT

A booklet containing an integral pop-up is formed from a continuous web of paper in an in-line process on a single apparatus.

22 Claims, 10 Drawing Figures

METHOD AND APPARATUS FOR PRODUCING POP-UP BOOKLETS

BACKGROUND OF THE INVENTION

The present invention relates generally to methods and apparatus for manufacturing pop-up booklets and more particularly to a method and apparatus for manufacturing a plurality of booklets, each containing an integral pop-up, in a continuous in-line process.

A pop-up booklet is a booklet which, in a closed or folded condition, has all of its pages and parts thereof lying in parallel planes but when opened or unfolded, it has a part, called a "pop-up", which springs up and extends transversely to the planes of the pages. The pop-up usually has a shape which, when combined with graphics and copy printed thereon and on the booklet pages surrounding the pop-up, presents an image of a familiar character or object, such as a clown or a house or the like.

Pop-ups may be integral or non-integral. A non-integral pop-up is one which is formed separately from the booklet and then is pasted therein. An integral pop-up is one which is formed integrally from the pages of the booklet.

Conventionally, booklets containing integral pop-ups have been produced in two separate, discrete steps on two separate pieces of apparatus. Typically, a first step involved die-cutting the outline of the pop-up on a booklet blank following which, the booklet blank, containing the die-cut pop-up outline, was folded into its closed condition on folding apparatus separate and discrete from the apparatus on which the die-cutting operation was performed.

The production of pop-up booklets in the manner described in the preceding paragraph was relatively slow, cumbersome, and inefficient and resulted in a relatively high cost for the pop-up booklet.

Pop-up booklets are useful for the advertising or promoting of goods or services. Such booklets are particularly desirable for this purpose because they are very successful in attracting the attention of a prospective purchaser of such goods or services when the booklet is opened, due to the pop-up action effected thereby. However, the relatively high cost required to produce pop-up booklets, when employing conventional manufacturing methods and apparatus, diminishes the frequency with which advertisers might employ pop-up booklets.

SUMMARY OF THE INVENTION

In accordance with the present invention, there is provided a method and apparatus for manufacturing a plurality of pop-up booklets in a continuous, in-line process from a continuous web of paper. All of the processing steps, including die-cutting and folding, are performed in-line, on a continuous web of paper, on a single piece of equipment. Separate machinery for die-cutting and folding and the need for folding individual blanks into pop-up booklets are eliminated.

As a result, pop-up booklets having integral pop-ups are produced rapidly, efficiently, and at reduced expense.

Other features and advantages are inherent in the method and apparatus claimed and disclosed or will become apparent to those skilled in the art from the following detailed description in conjuction with the accompanying diagrammatic drawings.

DETAILED DESCRIPTION

Figure 1:
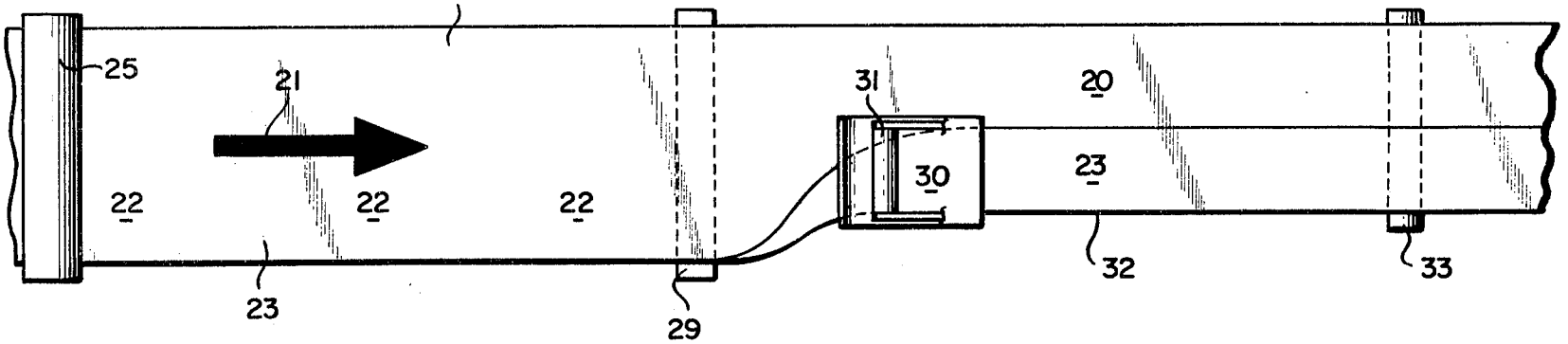
FIG. 1 is a plan view illustrating an upstream step in a method and an upstream portion of an apparatus in accordance with an embodiment of the present invention.

Referring to the drawings, there is illustrated a continuous web of paper 20 having a pair of longitudinal marginal parts 23, 24 and divisible into a plurality of web portions 22, 22 extending in end-to-end relation in a longitudinal direction on web 20. Each web portion 22 constitutes a blank from which a single integral pop-up booklet will be formed. Web 20 is advanced downstream in a longitudinal direction along a predetermined path shown in FIGS. 1–8. The direction of advancement is indicated by arrow 21.

Figure 2:
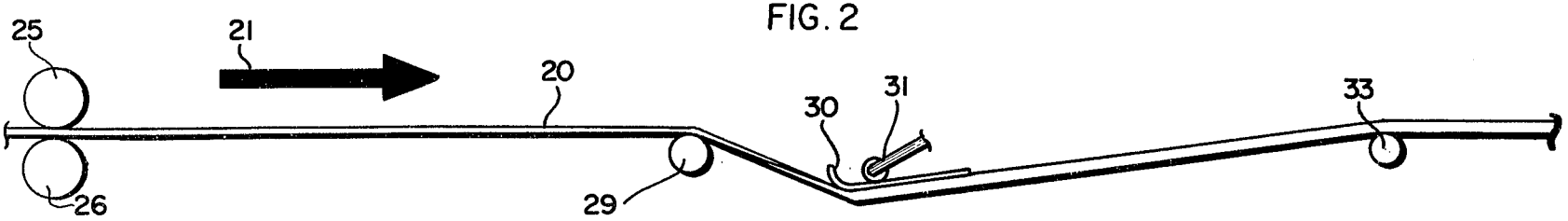
FIG. 2 is a side view illustrating the step and apparatus portion of FIG. 1.

In accordance with the present invention, a printing step is performed on each of the web portions at a printing station located at the upstream end of the path portion illustrated in FIGS. 1 and 2, or upstream thereof. One marginal part 23 of web 20 is folded into lapping relation with at least part of the remainder of the web, and this operation is performed along that part of the path illustrated in FIGS. 1 and 2.

Figure 3:
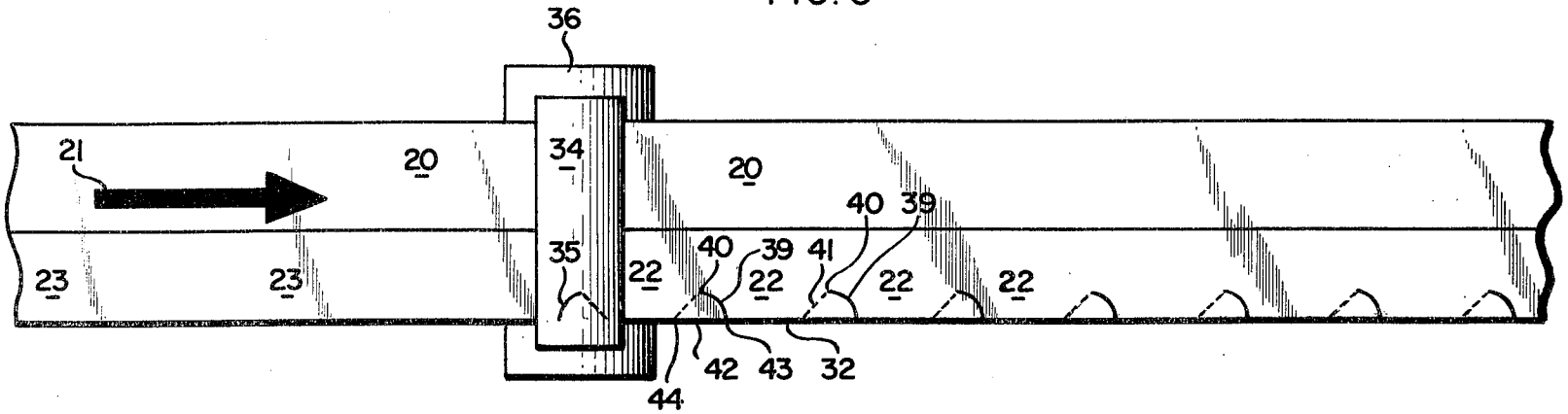
FIG. 3 is a plan view illustrating another step and apparatus portion in accordance with the present invention.
Figures 4, 5, 6, 10:
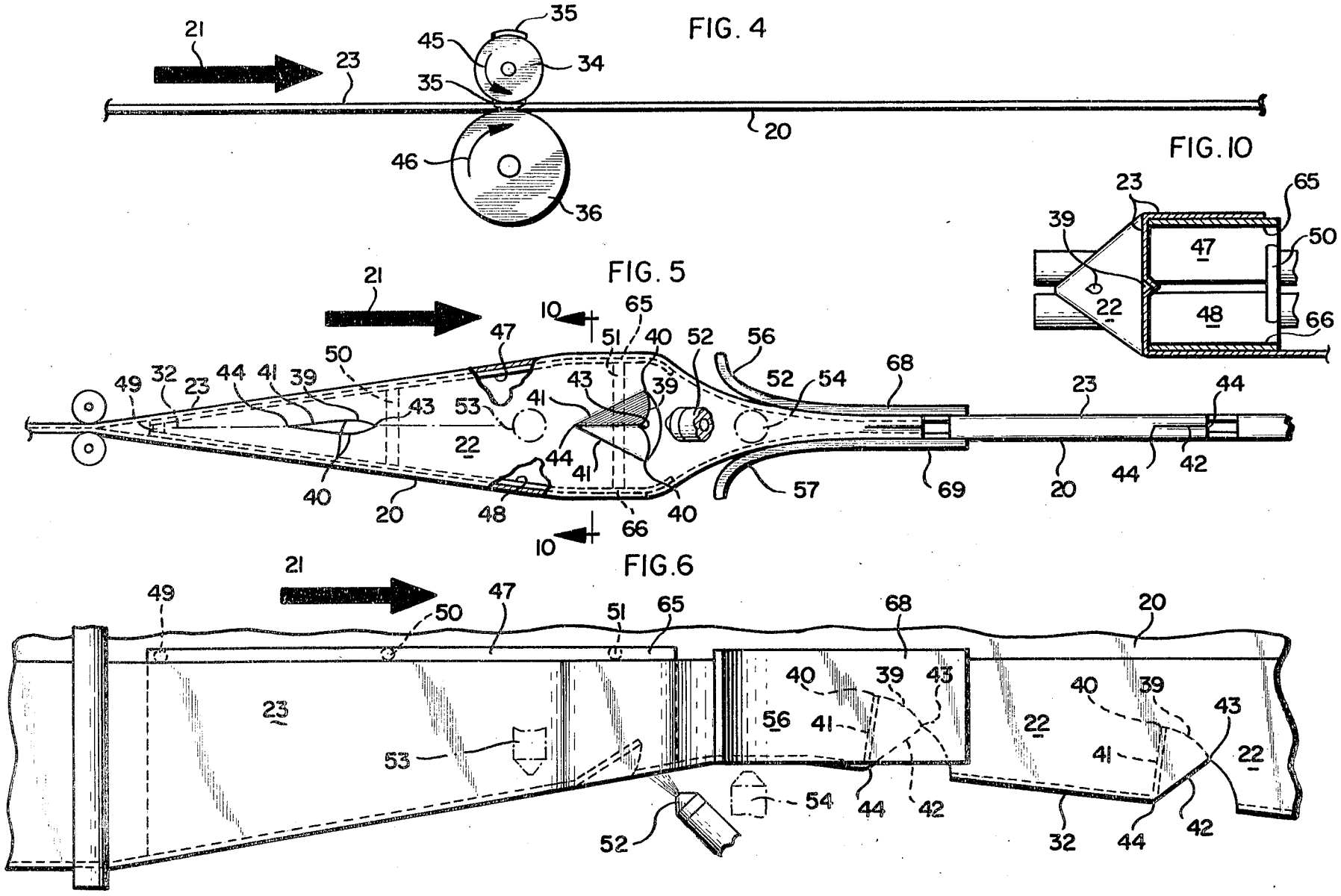
FIG. 4 is a side view illustrating the step and apparatus portion of FIG. 3.
FIG. 5 is an enlarged side view of a further step and apparatus portion.
FIG. 6 is an enlarged plan view illustrating the step and apparatus portion of FIG. 5.
FIG. 10 is a sectional view taken along line 10—10 in FIG. 5.

A predetermined pop-up outline is cut on each web portion 22, through the double-ply thickness thereof, at a location along the path illustrated in FIGS. 3 and 4. Also formed on each web portion 22, at the same path location, is a perforated line extending through the double-ply thickness of the web portion to form a pop-up fold line in each ply. As a result of the cutting and forming steps performed at the location illustrated in FIGS. 3 and 4, each web portion 22 has a symmetrical pop-up defined by the pop-up outline and the pop-up fold lines, with the webs longitudinal fold line extending along the middle of the pop-up.

Figure 7:
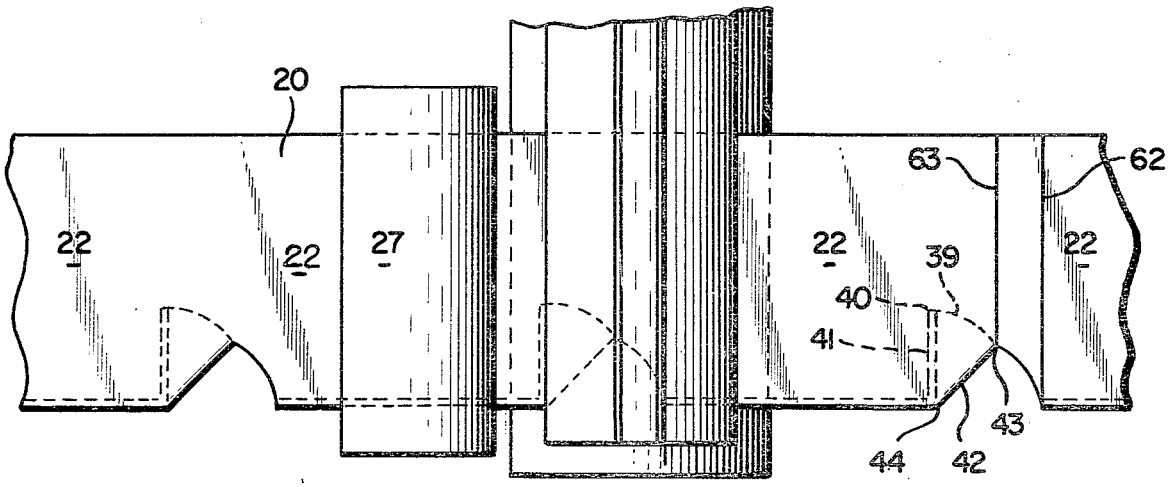
FIG. 7 is an enlarged plan view of a downstream step and apparatus portion.
Figure 8:
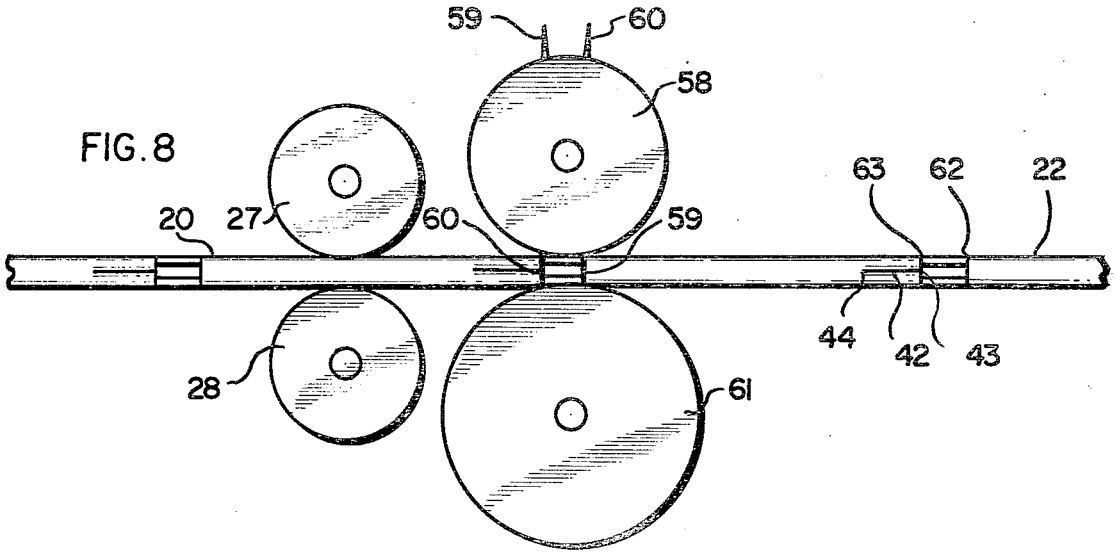
FIG. 8 is an enlarged side view of the step and apparatus portion of FIG. 8.

At a location along the path illustrated in FIGS. 5–6, the pop-up is reverse folded, and at a location illustrated in FIGS. 7 and 8, each web portion is severed from the web and trimmed in the area of the pop-up outline.

The method and apparatus will now be described in greater detail. Web 20 is advanced downstream along its path in the direction of arrow 21 by conventional mechanically driven roller means 27, 28 located at the downstream end of the path (FIGS. 7–8).

At the upstream end of the path portion illustrated in FIGS. 1 and 2 is a printing station defined by a pair of printing rolls 25, 26 for imprinting graphics or copy on each web portion 22 as it moves past the printing station.

From the printing station at 25, 26 web 20 is advanced downstream over a roller 29 to a folding station defined by a folding element or plow shoe 30 urged against the top surface of web 20 by a plow shoe holder 31, both plow shoe 30 and plow shoe holder 31 being of conventional construction. Plow shoe 30 and plow shoe holder 31 constitute structure for folding marginal part 23 of web 20 into lapping relation with at least part of the remainder of web 20, to provide at least part of the lateral dimension of the web with a double-ply thickness downstream of the folding station at 30, 31. As a result of the folding step, there is formed on web 20 a longitudinal fold line or edge 32. Following the folding step, a web portion 22 is advanced downstream from the folding station over a roller 33.

Referring to FIGS. 3–4, located downstream of the folding station is a cutting station defined by a rotatable die-cutting roller 34 having die-cutting blades 35, 35, located above web 20, and a rotatable anvil roller 36 located below web 20. Rollers 34, 36 are rotated in the direction of the arrows 45, 46 as shown in FIG. 4.

As each web portion 22 passes the cutting station at 34, 36, cutting blades 35, 35 cut a predetermined pop-up outline on the web portion, through the double-ply thickness thereof, to form one-half 39 of the pop-up outline in each ply. Each pop-up outline half 39 extends from a pop-up outline midpoint 43 at longitudinal fold line 32, along the web, to a pop-up outline end 40.

Cutting blades 35, 35 also form on each web portion 22, in conjunction with the production of the pop-up outline, a perforated line 41 extending through the double-ply thickness of the web portion to form a pop-up fold line in each ply. More particularly, during the forming step described in the preceding sentence, there is formed, on each lap of a web portion 22, a perforated pop-up fold line 41 extending from longitudinal fold line 32, at a location 44 thereon longitudinally displaced from the pop-up outline midpoint 43, to an end 40 of the pop-up outline. Accordingly, each web portion 22 which has undergone the above-described cutting and forming steps includes a symmetrical pop-up defined by pop-up outline halves 39, 39 and pop-up fold lines 41, 41 with the web's longitudinal fold line 32 extending through the middle of the pop-up (see FIG. 5).

After the cutting and forming steps described above, web 20 is advanced in a downstream direction to an unlapping station illustrated in FIGS. 5, 6 and 10. The unlapping station comprises a pair of planar guide members 47, 48, which initially diverge in a downstream direction and then terminate at respective parallel downstream guide portions 65, 66. Guide members 47, 48 are maintained in spaced apart relation by posts 49, 50, 51.

Web marginal part 23 and that part of the remainder of web 20 which marginal part 23 overlaps are unlapped at the unlapping station defined by guide members 47, 48. This is accomplished by running the outer portion of marginal part 23 over guide member 47 and guiding that part of the remainder of web 20 which is overlapped by the outer portion of marginal part 23 under guide member 48, as illustrated in FIGS. 5, 6 and 10. At the same time, that part of a web portion 22 containing longitudinal fold line 32, pop-up outline halves 39, 39 and pop-up fold lines 41, 41 is directed into a plane which is transverse to the plane of web 20 upstream of the unlapping station. That part of longitudinal fold line 32 which extends through the middle of the pop-up is indicated at 42 in FIG. 5.

When a web portion 22 has advanced to a location alongside column 51 at the unlapping station, it has been completely unlapped, and the pop-up is there subjected to a reverse folding step employing, in the illustrated embodiment, nozzle 52 for directing an air jet against pop-up 39–44. An air jet directed against the pop-up by nozzle 52 causes a reverse folding of the pop-up by urging it inwardly along that part 42 of longitudinal fold line 32 extending through the middle of the pop-up. In lieu of air jet nozzle 52, a mechanical kicker of conventional construction may be employed for the reverse folding step. The reverse folding step is performed while the web portion containing the pop-up undergoing the reverse folding is in the transverse plane.

To assist in effecting the reverse folding of the pop-up, there may be optionally employed an air jet nozzle 53 located upstream of nozzle 52 and an air jet nozzle 54 located downstream of nozzle 52. Air jet nozzle 53 urges outwardly, at the time of the reverse folding of the pop-up, a part of the corresponding web portion 22 which is adjacent to and upstream of that pop-up. Air jet nozzle 54 urges inwardly, at the time of the reverse folding of the pop-up, a part of the corresponding web portion 22 which is adjacent to and downstream of that pop-up.

After the pop-up has been reverse folded, those parts of the web containing the reverse-folded pop-up and which were previously folded into lapping relation are subjected to relapping. Relapping is accomplished by a pair of relapping guide members 56, 57, located downstream of unlapping guide members 47, 48 and initially arcuately converging toward each other in a downstream direction and then terminating at respective parallel guide portions 68, 69.

As previously indicated, with reference to FIG. 1, the web contains a marginal part 24 opposite folded and lapped marginal part 23. If the booklet containing the pop-up is to have only two pages, then marginal part 24 may be eliminated from the web entirely. If the pop-up booklet is to contain more than two pages, then marginal part 24 should be folded into lapping relation with an adjacent part of the web unlapped by marginal part 23, employing procedures and apparatus similar to that shown in FIG. 1 for lapping marginal part 23.

The folding and lapping of marginal part 24 may be performed at virtually any location along the path of web 20, so long as marginal part 24 need not be simultaneously folded into some kind of lapping relationship with marginal part 23. In the latter event, the folding of marginal part 24 should occur after the reverse folding and relapping steps described above, but before the web portions 22 are severed from the web.

A severing step is illustrated in FIGS. 7 and 8, and in these figures, the web is portrayed as though marginal part 24 had been eliminated therefrom entirely, so as to provide a pop-up booklet with two pages. As shown in FIGS. 7–8, web portions 22 are severed from web 20 with severing structure comprising a cutting roller 58 having severing blades 59, 59 and trimming blades 60, 60, all of which are located above web 20, and an anvil roller 61 located below web 20. Cutting blades 59, 59 sever web portions 22, 22 from web 20 along a transverse severance line 62, and trimming blades 60, 60 trim web portions 22, 22 along a transverse trim line 63 in the area of pop-up outline 39–44.

At the time of the performance of the severing and trimming steps on a respective web portion 22, there are simultaneously being performed on respective web portions upstream of the web portion undergoing severing and trimming a respective one of each of the steps previously described above, including the printing step, the folding step, the die-cutting and perforate line-forming steps, the unlapping step, the reverse folding step, the relapping step and additional folding steps where appropriate. More particularly, all of the aforementioned steps are being performed simultaneously on respective web portions in a continuous in-line process on a single apparatus. Web 20 is moved continuously past all of the stations illustrated in FIGS. 1–8, and the various structural and mechanical parts of the apparatus perform their intended functions as a given web portion moves past the location of that particular part.

Figure 9:
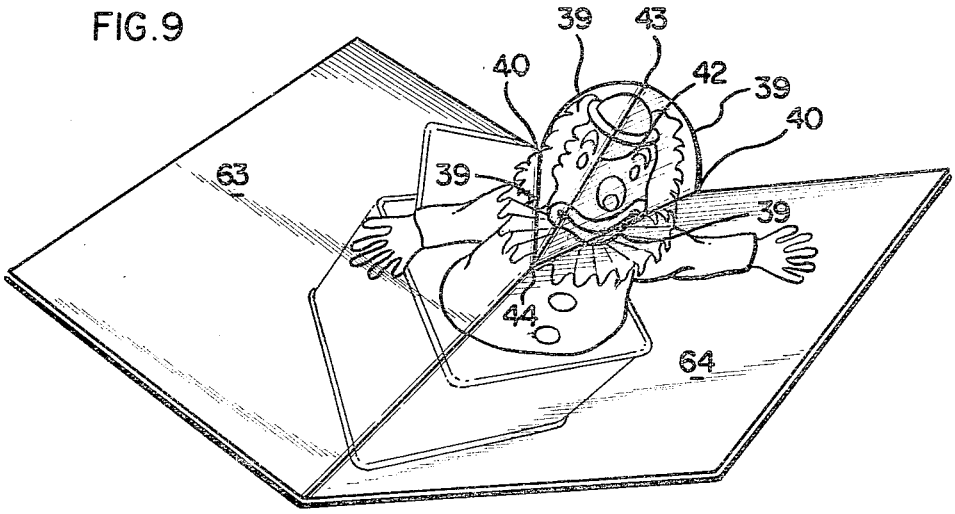
FIG. 9 is a perspective of a pop-up booklet produced in accordance with the method and apparatus of the present invention.

FIG. 9 illustrates a two-page pop-up booklet made in accordance with the method and apparatus described above. One page, 64, of the booklet was formed from longitudinal part 23 of web 20, and the other page, 63, was formed from that part of the web 20 which longitudinal part 23 overlapped. The graphics imprinted on pages 63, 64, in the embodiment illustrated in FIG. 9, is a jack-in-the-box, and the pop-up 39–44 forms the head of the jack-in-the-box. When pages 63–64 of the booklet are folded into lapping relationship, the pop-up 39–44 is folded into a pair of planes parallel to the planes of pages 63, 64. When pages 63, 64 are opened, this causes pop-up 39–44 to move into planes transverse to the planes of both pages 63, 64, thereby providing a three-dimensional effect.

Referring once again to the reverse folding step, to assist in this step, it may be helpful to form perforations along that part 42 of the longitudinal fold line 32 which extends through the middle of a pop-up 39–44. These perforations can be formed with a die-cutting roller and an anvil roller similar to those illustrated at 34–36 in FIG. 4. The perforations at 42 can be formed either before or after the step in which longitudinal part 23 gets folded into lapping relation with at least part of the remainder of web 20 (FIGS. 1–2). If the perforations at 42 are formed before the folding step, then a single line of perforations may be formed at a location corresponding to where longitudinal fold line 32 will eventually be formed. If the perforations are formed downstream of the location where the folding step is performed, then the line of perforations is located immediately adjacent longitudinal fold line 32, and this will produce a line of perforations in each of the two plies of the double-ply thickness resulting from the folding of longitudinal part 23 over at least part of the remainder of web 20.

Referring once again to the unlapping and relapping steps illustrated in FIGS. 5–6, in lieu of guide members 47, 48 and 56, 57, there may be substituted a multiplicity of guide rollers. More particularly, in lieu of guide member 47, a set of guide rollers may be located along the planes defined by upper guide member 47 and arranged to bear against the inside surface of that part of lap portion 23 which rides atop guide member 47. Similarly, another set of guide rollers may be located along the planes defined by lower guide member 48 and arranged to bear against the inside surface of web 20 where the latter rides beneath guide member 48. In addition, a plurality of rollers may be located along the plane of each of guide members 56, 57 and arranged to bear against the outside surface of web part 23 and web 20, respectively.

The foregoing detailed description has been given for clearness of understanding only, and no unnecessary limitations should be understood therefrom, as modifications will be obvious to those skilled in the art.

I claim:

1. A method for manufacturing a plurality of pop-up booklets in a continuous, in-line process, said method comprising:

providing a continuous web of paper having a pair of longitudinal marginal parts and divisible into a plurality of web portions extending in end to end relation in a longitudinal direction on said web;

advancing said continuous web downstream in a longitudinal direction along a predetermined path;

providing a folding station at a first location on said path;

folding one marginal part of said web into lapping relation with at least part of the remainder of the web, at said folding station, to provide at least part of the lateral dimension of said web with a double ply thickness downstream of said folding station;

forming a longitudinal fold line on said web as a result of said folding step;

providing a cutting station at a location on said path downstream of said folding station;

cutting a predetermined pop-up outline on a web portion, through the double ply thickness thereof, to form one-half of the pop-up outline in each ply, as that web portion passes said cutting station;

forming on said web portion, in conjunction with said pop-up outline, a perforated line extending through the double ply thickness of the web portion to form a pop-up fold line in each ply;

said cutting step comprising forming, on each lap of the web portion, a pop-up outline-half extending from a pop-up outline midpoint at said longitudinal fold line, along the web, to a pop-up outline end;

said step of forming said perforated line comprising forming, on each lap of the web portion, a pop-up fold line extending from said longitudinal fold line, at a location thereon longitudinally displaced from said pop-up outline midpoint, to an end of the pop-up outline, whereby each portion of said web which has undergone said cutting and forming steps includes a symmetrical pop-up defined by said pop-up outline and said pop-up fold lines, with the webs longitudinal fold line extending through the middle of said pop-up;

reverse folding said pop-up by urging it inwardly along that part of said longitudinal fold line extending through the middle of said pop-up;

and then severing from the web each portion thereof containing a reverse folded pop-up;

at the time of said severing step, each of said cutting, forming, reverse folding, and severing steps being performed on a respective portion of the continuous web simultaneously with the performance of each of the other steps.

2. A method as recited in claim 1 and comprising:

providing an unlapping station at a location on said path downstream of the location where said cutting and forming steps are performed;

unlapping the double thickness part of said web at said unlapping station and directing at least that part of a web portion containing said longitudinal fold line, said pop-up outline and said pop-up fold lines into a plane which is transverse to the plane of the web upstream of said unlapping station;

said reverse folding step being performed while the web portion, containing the pop-up undergoing said reverse folding, is in said transverse plane;

and relapping those parts of said web which were previously folded into lapping relation, after said reverse folding step;

at the time of said severing step, each of said unlapping, said relapping and said other steps being performed on a respective portion of the continuous web simultaneously with the performance of each of the other steps.

3. A method as recited in claim 1 and comprising:

forming perforations along that part of the longitudinal fold line which extends through the middle of a pop-up.

4. A method as recited in claim 3 wherein:

said step of forming perforations along the longitudinal fold line is performed after said folding step and before said reverse folding step and comprises locating said perforations immediately adjacent said longitudinal fold line, thereby providing a line of perforations in each of said plies.

5. A method as recited in claim 3 wherein:

said step of forming perforations along the longitudinal fold line is performed before said folding step.

6. A method as recited in claim 1 and comprising:

urging outwardly, at the time of said reverse folding of the pop-up, a part of the corresponding web portion which is adjacent to and upstream of that pop-up.

7. A method as recited in claim 1 and comprising:

urging inwardly, at the time of said reverse folding of the pop-up, a part of the corresponding web portion which is adjacent to and downstream of that pop-up.

8. A method as recited in claim 7 and comprising:

urging outwardly, at the time of said reverse folding of the pop-up, a part of the corresponding web portion which is adjacent to and upstream of that pop-up.

9. A method as recited in claim 1 and comprising:

folding the other marginal part of said web, opposite said one marginal part, into lapping relation with at least part of the remainder of the web, before said severing step.

10. A method as recited in claim 1 and comprising:

trimming the web portion in the area of said pop-up outline, in conjunction with said severing step.

11. A method as recited in claim 1 and comprising:

providing a printing station at a location on said path upstream of said folding station;

and printing copy on a web portion as that portion passes said printing station;

said performing step comprising performing said printing step on a respective web portion simultaneously with the performance of each of said other steps on other respective web portions.

12. An apparatus for manufacturing a plurality of pop-up booklets from a continuous web of paper having a pair of longitudinal marginal parts and divisible into a plurality of web portions extending in end to end relation in a longitudinal direction on said web, said apparatus comprising:

means defining a predetermined path for said continuous web;

means for advancing said continuous web downstream in a longitudinal direction along said predetermined path;

means defining a folding station at a first location on said path;

means for folding one marginal part of said web into lapping relation with at least part of the remainder of the web, at said folding station, to provide at least part of the lateral dimension of said web with a double ply thickness downstream of said folding station;

said folding means comprising means for forming a longitudinal fold line on said web as a result of said folding step;

means defining a cutting station at a location on said path downstream of said folding station;

means for cutting a predetermined pop-up outline on a web portion, through the double ply thickness thereof, to form one-half of the pop-up outline in each ply, as that web portion passes said cutting station;

means for forming on said web portion, in conjunction with said pop-up outline, a perforated line extending through the double ply thickness of the web portion to form a pop-up fold line in each ply;

said cutting means comprising means for forming, on each lap of the web portion, a pop-up outline half extending from a pop-up outline midpoint at said longitudinal fold line, along the web, to a pop-up outline end;

said means for forming said perforated line comprising means for forming, on each lap of the web portion, a pop-up fold line extending from said longitudinal fold line, at a location thereon longitudinally displaced from said pop-up outline midpoint, to an end of the pop-up outline;

said cutting means and said perforated line forming means comprising means cooperating to provide each portion of said web which has advanced beyond said cutting station with a symmetrical pop-up defined by said pop-up outline and said pop-up fold lines, with the webs longitudinal fold line extending through the middle of said pop-up;

means for reverse folding said pop-up by urging it inwardly along that part of said longitudinal fold line extending through the middle of said pop-up;

means for severing from the web each portion thereof containing a reverse folded pop-up;

and means for performing, at the time of said severing operation, each of said cutting, forming, reverse folding, and severing operations on a respective portion of the continuous web simultaneously with the performance of each of the other operations.

13. An apparatus as recited in claim 12 and comprising:

means defining an unlapping station at a location on said path downstream of the location where said cutting and forming steps are performed;

means for unlapping the double thickness part of said web at said unlapping station and for directing at least that part of a web portion containing said longitudinal fold line, said pop-up outline and said pop-up fold lines into a plane which is transverse to the plane of the web upstream of said unlapping station;

said reverse folding means being located alongside that part of the web portion, containing the pop-up undergoing said reverse folding, which is in said transverse plane;

and means for relapping those parts of said web containing a reverse-folded pop-up and which were previously folded into lapping relation;

said performing means comprising means for performing, at the time of said severing operation, each of said unlapping, said relapping, and said other operations on a respective portion of the continuous web simultaneously with the performance of each of the other operations.

14. An apparatus as recited in claim 12 and comprising:

means for forming perforations along that part of the longitudinal fold line which extends through the middle of a pop-up.

15. An apparatus as recited in claim 14 wherein:

said means for forming perforations along the longitudinal fold line is located downstream of said folding means and upstream of said reverse folding means and comprises means for locating said perforations immediately adjacent said longitudinal fold line, thereby providing a line of perforations in each of said plys.

16. An apparatus as recited in claim 14 wherein:

said means for forming perforations along the longitudinal fold line is located upstream of said folding means.

17. An apparatus as recited in claim 12 and comprising:

means for urging outwardly, at the time of said reverse folding of the pop-up, a part of the corresponding web portion which is adjacent to and upstream of that pop-up.

18. An apparatus as recited in claim 12 and comprising:

means for urging inwardly, at the time of said reverse folding of the pop-up, a part of the corresponding web portion which is adjacent to and downstream of that pop-up.

19. An apparatus as recited in claim 18 and comprising:

means for urging outwardly, at the time of said reverse folding of the pop-up, a part of the corresponding web portion which is adjacent to and upstream of that pop-up.

20. An apparatus as recited in claim 12 and comprising:

means for folding the other marginal part of said web, opposite said one marginal part, into lapping relation with at least part of the remainder of the web, at a location upstream of said severing means.

21. An apparatus as recited in claim 12 and comprising:

means for trimming the web portion in the area of said pop-up outline, at a location corresponding substantially to that of said severing means.

22. An apparatus as recited in claim 12 and comprising:

means defining a printing station at a location on said path upstream of said folding station;

and means for printing copy on a web portion as that portion passes said printing station;

said performing means comprising means for performing said printing operation on a respective web portion simultaneously with the performance of each of said other operations on other respective web portions.

* * * * *